United States Patent [19]

Petersen et al.

[11] Patent Number: 4,912,957

[45] Date of Patent: Apr. 3, 1990

[54] SMART STRAIGHTENING PRESS

[75] Inventors: Paul S. Petersen, Minnetonka; Virgil C. Hed, Edina, both of Minn.

[73] Assignee: Dayton Rogers Manufacturing Company, Minneapolis, Minn.

[21] Appl. No.: 345,009

[22] Filed: Apr. 28, 1989

[51] Int. Cl.[4] ..... B21D 3/10

[52] U.S. Cl. ..... 72/389; 72/10; 72/21; 72/32; 72/702

[58] Field of Search ..... 72/10, 21, 30, 389, 72/702, 380, 32

[56] References Cited

U.S. PATENT DOCUMENTS

| | | | |
|---|---|---|---|
| 1,840,237 | 1/1932 | Leighton | 72/389 |
| 2,426,390 | 8/1947 | De Forest | 72/389 |
| 2,748,829 | 6/1956 | Korenak | 72/389 |
| 2,765,836 | 10/1956 | Niekelski | 72/389 |
| 4,154,073 | 5/1979 | Galdabini | 72/389 |

FOREIGN PATENT DOCUMENTS

| | | | |
|---|---|---|---|
| 1169256 | 4/1964 | Fed. Rep. of Germany | 72/389 |
| 0330712 | 7/1973 | U.S.S.R. | 72/389 |

*Primary Examiner*—David Jones
*Attorney, Agent, or Firm*—Kinney & Lange

[57] ABSTRACT

A straightening press of the type wherein a workpiece is supported for deflection in a given direction by an anvil engageable with the workpiece. A reference spring is supported for deflection with the reference spring supports being serially interconnected with the anvil. In a preferred embodiment, a floating bridge carries the anvil and reference spring supports. Deflecting force applied to the reference spring, as by a ram, is transmitted to the workpiece via the floating bridge. A change in the differential displacement of the ram and floating bridge is detected to determine the onset of plastic deformation of the workpiece.

15 Claims, 2 Drawing Sheets

SMART STRAIGHTENING PRESS

BACKGROUND OF THE INVENTION

1. Field of the Invention

The present invention relates to a straightening press and, in particular, to a straightening press wherein the workpiece is deflected, plastic yield in the workpiece is detected and the workpiece further deflected by a predetermined amount to straighten the same.

2. Description of the Prior Art

During the fabrication of parts, notably bars and flat plates, there is a tendency for distortion. This is particularly true when the part is heat-treated. This distortion necessitates a straightening of the part. Typically, such straightening has been accomplished by a press operated by a skilled operator employing a trial and error technique. This technique requires a significant amount of time and operators who are increasingly difficult to find. The net result is a straightening operation having relatively high costs and a likelihood that those costs will increase as time passes. In one instance known to the inventors of the present invention, the cost of straightening a particular part is approximately the same as the cost of carburizing and hardening.

SUMMARY OF THE INVENTION

The present invention eliminates the trial and error technique noted above and is particularly well-suited for steel materials. In that context, the present invention takes advantage of the change from elastic to plastic deformation with increasing load. It will be obvious to those familiar with the art that the present invention is dependent upon this stress/strain characteristic as opposed to the characterization of the material as "steel." It is therefore to be understood that the present invention is not to be construed as being limited to a straightening of steel parts.

FIG. 1 is a stress/strain diagram of a typical steel rod or bar which indicates deflection as a function of load. With increasing load, there is a linear deflection of the part until the point 10 is reached. To this point, deflection is elastic, with the part assuming its original shape when the load is released. At point 10, the slope of the curve changes anywhere from slightly to drastically as a result of plastic deformation of the part. Further deflection will result in a "set" in the part. For example, removing the load after deflection to the point represented at 11 in FIG. 1 will result in a permanent "set" of the part represented by the arrow D in FIG. 1.

For many parts and/or materials, it is relatively easy to determine the amount of deformation or deflection necessary past the "yield point" (point 10 in FIG. 1) to result a desired "straightening." The difficulty lies in a determination of the yield point—the point from which this additional deformation is measured. The present invention accomplishes this through the use of a reference whose load/deflection characteristics are matched to those of the part to be straightened but which remains elastic in the region of the onset of plastic deformation of the part—point 10 in FIG. 1. The load/deflection characteristics of the reference are illustrated by the dashed line 12 in FIG. 1.

In its broadest sense, the present invention simultaneously applies a load to a part to be straightened and a reference spring. In the disclosed embodiments, this is accomplished by a weightless or floating bridge which carries supports for the reference spring as well as an anvil employed to deflect the workpiece. A deflecting force applied to the reference spring is serially applied to the part to be straightened through the agency of the floating bridge while the relative deflections of the spring and part are monitored. Comparison of the relative deflections of part and spring allows a detection of plastic deformation of the part more easily than a monitoring of deflection of the part alone. Thereafter, after the onset of plastic deformation, deformation or deflection of the part to be straightened may be controlled to accomplish the desired "set" in the part. More particularly, the present invention employs a transducer that is differentially responsive to the deflection of the spring and part for the detection of plastic deformation of the part.

DETAILED DESCRIPTION OF THE PREFERRED EMBODIMENTS

The present invention will be described in the context of a straightening of a steel rod or bar. For that purpose, the term "deflection" is employed as being aptly descriptive of the response of a rod or bar to a deforming (straightening) force. It is to be understood, however, that the concepts of the present invention may be equally applicable to plates or constructions of other configurations without departing from the scope of the present invention.

Figure 2:
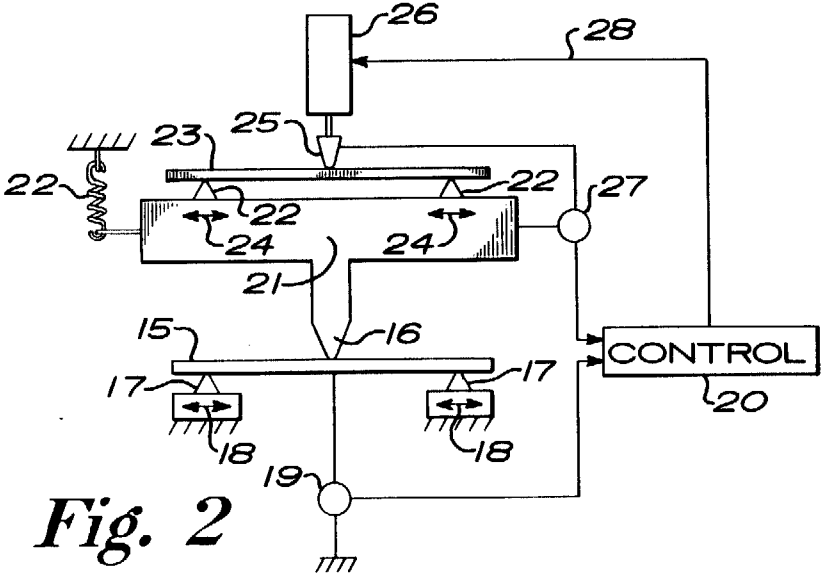
FIG. 2 is a schematic illustration of a preferred embodiment in accordance with the present invention.

FIG. 2 is a schematic illustration of a press for straightening a rod or bar in accordance with the present invention wherein the rod or bar is represented by a workpiece 15 supported for deflection by an anvil 16. The supports 17 for the workpiece 15 are mounted for adjustment as indicated by the arrows 18 while the deflection of the workpiece 15 may be monitored by a transducer 19. The transducer 19 is connected to a control 20 which, for the purposes of the transducer 19, may be of any type known to the prior art capable of monitoring the physical location of the surface of the workpiece 15 and providing a signal representative of that location.

The anvil 16 is carried by a floating bridge 21 that is supported for movement toward and away from the workpiece 15 in any desired manner. The term "floating" indicates that the bridge 21 is essentially weightless, with its weight being compensated for as represented by spring 22, in a manner known to the prior art. As will be apparent to those familiar with the art, a force applied to the bridge 21 will be transmitted by the bridge 21 to the workpiece 15 via the anvil 16.

Figure 1:
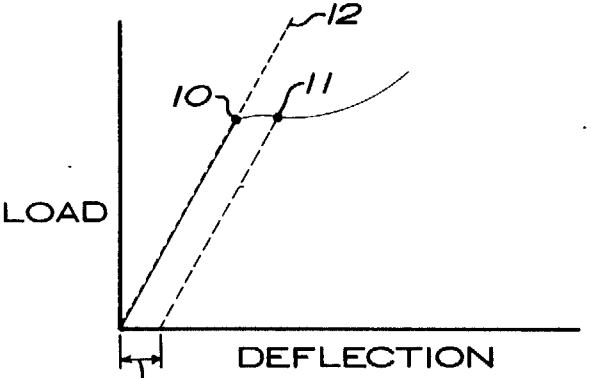
FIG. 1 illustrates a typical load/deflection curve for a part to be straightened in accordance with the present invention as well as that of a reference spring employed in the practice of the present invention.

The bridge 21 carries adjustable supports 22 for a reference spring 23, the adjustability of the supports 22 being represented by the arrows 24. Generally, the material of the reference spring 23 will be similar to that of the workpiece 15 such that their load/deflection characteristics are similar. As will be apparent from the following discussion, the supports 22 may be adjusted to match the spring constant of the reference spring 23 to that of the workpiece 15. However, the reference spring 23 will be dimensioned such that its load/deflection characteristics remain elastic with increasing load through the anticipated onset of plastic deformation of the workpiece 15—as represented by the dashed line 12 in FIG. 1 and its linear extension past the point 10.

In the embodiment of FIG. 2, the reference spring 23 is engaged by a ram 25, the ram being carried by a rod extending from a powered cylinder 26. As will be apparent to those familiar with the art, the cylinder 26 may be of any known type. It is anticipated that a hydraulic cylinder will be employed to drive the ram 25. Also, as illustrated in FIG. 2, the ram acts on the reference spring 23 on extension of the rod from the cylinder 26. In other embodiments, the embodiment of FIG. 3, for example, the spring 23 may be deflected by retraction of the cylinder rod. For the sake of clarity, the term "ram" is continued throughout this specification and claims for functionally similar elements, it being understood that the term "ram" does not necessarily imply "pushing" action.

Movement of the ram 25 as well as movement of the bridge 21 are monitored by a transducer 27, the transducer 27 having an output connected to the control 20. Control 20 may serve to control the cylinder 26 as represented by the line 28. The transducer 27 may be of any type known to the prior art capable of monitoring movement of the ram 25 and bridge 21 and detecting a change in the ratio of the movements therein. In a preferred embodiment, the transducer 27 is a differential transducer whose inputs are "corrected" to be equal on equal deflection of the workpiece 15 and reference spring 23.

In operation, a reference spring 23 having the desired characteristics (including desired load/deflection characteristics) is positioned on the supports 22. Thereafter, a workpiece is positioned on the supports 17. In the instance of a rod, for example, the rod may then be rotated about its axis with the transducer 19 monitoring its deflection. Assuming the transducer 19 to be "zeroed" at a rod surface location corresponding to a straight rod, the maximum output of the transducer 19 will represent twice the amount of deformation necessary to bring the rod to a "straight" configuration. It should be clear that the output of the transducer 19 can also be employed to detect that orientation of the workpiece 15 which places a maximum offset from "straight" under the anvil 16. This is the desired orientation of the rod during the straightening operation.

With the workpiece in place on the supports 17, and the amount of offset from straight determined, the ram 25 may then be extended to engage the spring 23. Increasing the force applied to the spring 23 results in a deflection of the spring 23 as well as the workpiece 15. The displacements of the ram 25 and anvil 16 are proportional and are dependent upon the spring constants of the spring 23 and workpiece 15. If the spring constants of the spring 23 and workpiece 15 are matched, the bridge 21 will move one-half the travel of the ram 25 while the deflections of the workpiece and spring will be equal. If the workpiece 15 deflects more than the reference spring 23, the operator can adjust the supports 22 to increase the distance between them, which will lower the spring constant of the reference spring. A series of trial and error pressings will result in a matching of the spring constant of the reference spring 23 to that of the workpiece 15. Thereafter, a pressing of the ram 25 on the reference spring 23 will result in a "matched" movement of the ram 25 and bridge 21—until the onset of plastic deformation in the workpiece 15. At this point, the control 20 may act to stop advancement of the ram 25. Thereafter, the operator may select a desired amount of additional deflection of workpiece 15 to result in a desired permanent set in the workpiece 15. Alternatively, the control 20 may be set to result in this additional deflection of the workpiece 15 and additional workpieces from the same lot. It should be apparent that many of the operations indicated herein as being operator operations may be automated within the scope of the present invention.

As noted above, a matching of the spring constants of the reference spring 23 and workpiece 15, results in the ram 25 moving twice the distance as the bridge 21. The transducer 27 may be employed to monitor this ratio of actual movements and to detect a departure from this ratio resulting from plastic deformation of the workpiece 15. Alternatively, the input to the transducer 27 resulting from movement of the floating bridge 21 may be "multiplied" such that the input to the transducer 27 represents twice the actual movement of the floating bridge 21. This results in a "zero" (or negligible) output from the transducer 27 on a correspondence of the spring constants of the workpiece 15 and reference spring 23. A zero/negligible output of transducer 27 is preferable in as much as a departure from "zero" is more easily detected than a variation in that output. A summing node is discussed with reference to FIG. 3 which allows such a zero output of transducer 27 on a matching of the spring constants of workpiece 15 and reference spring 23.

Figure 4:
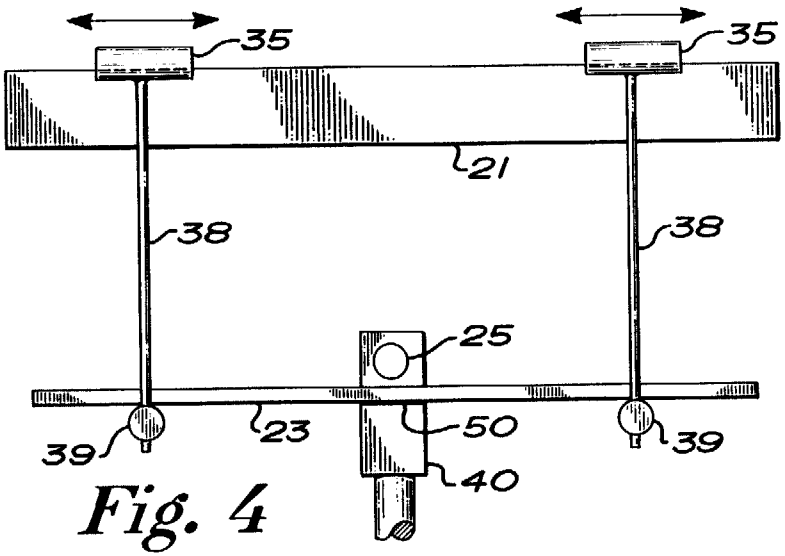
FIGS. 4 and 5 illustrate operational characteristics of a portion of the embodiment illustrated in FIG. 3.
Figure 5:
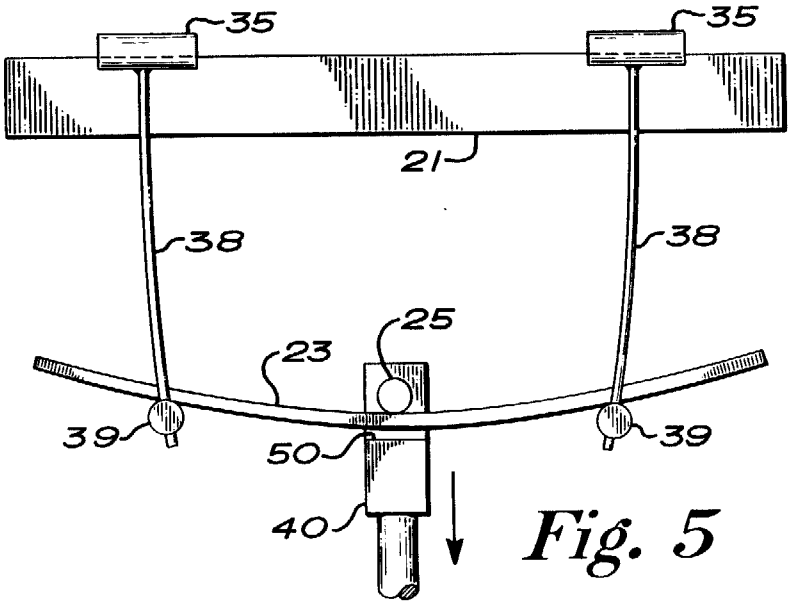
Figure 3:
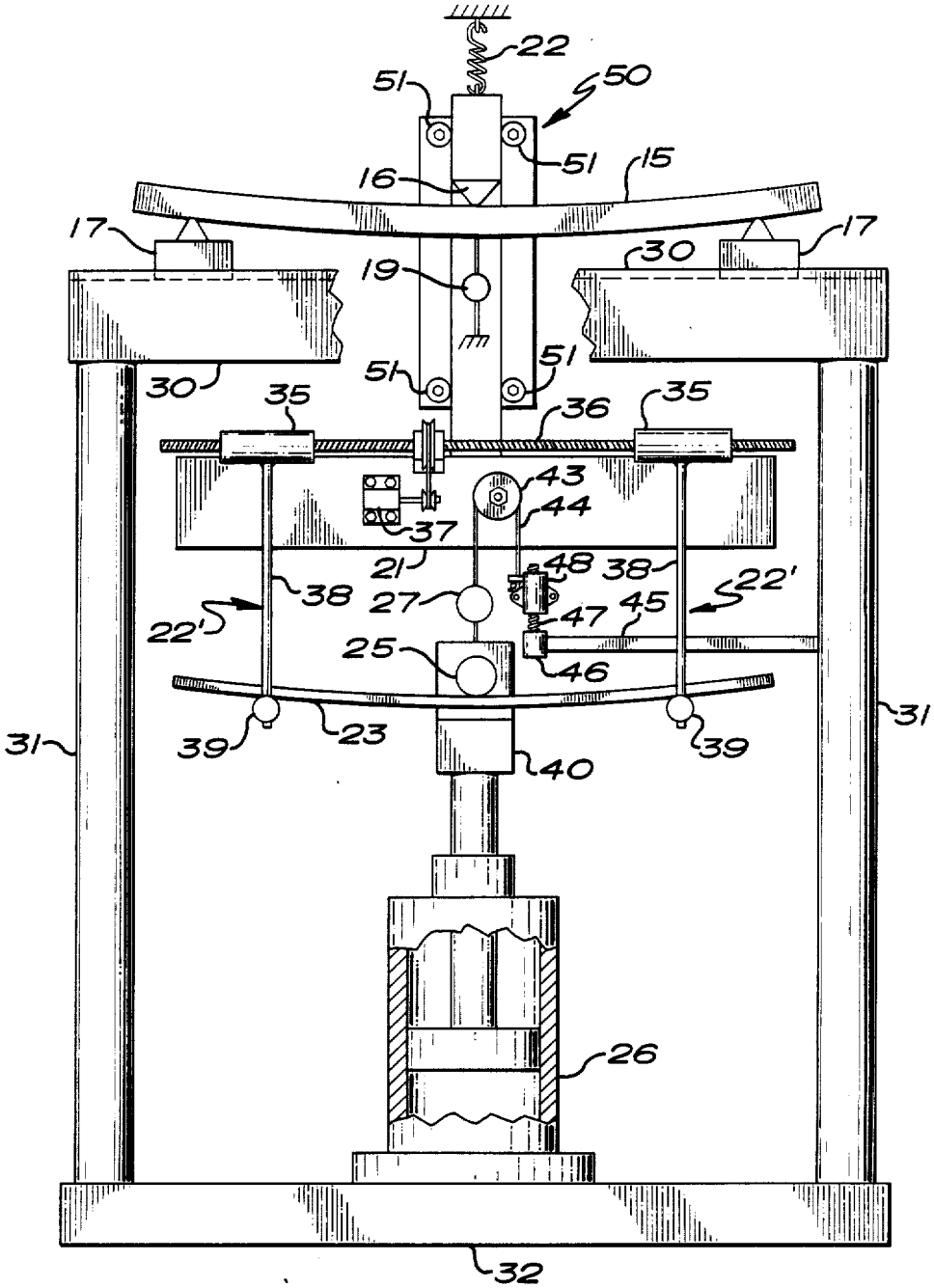
FIG. 3 is a diagrammatic illustration of a preferred embodiment in accordance with the present invention.

FIGS. 3-5 diagrammatically illustrate a preferred embodiment in accordance with the present invention. For the purposes of clarity, elements functionally equivalent to those discussed above with reference to FIG. 2 are indicated by identical reference numerals. For example, the embodiment of FIGS. 3-5 acts on a workpiece 15 and employs a reference spring 23. In the embodiment of FIGS. 3-5, the workpiece 15 is supported on supports 17, the supports being positioned on and slidable along a work table 30. The work table 30 is partially cut away for the sake of illustration. The work table 30 is part of a frame including upstanding members 31 and a base 32. The base 32 supports a hydraulic cylinder 26 whose extending rod carries a ram 25. As is apparent from FIG. 3, the ram 25 engages the reference spring 23 and deflects the reference spring 23 on retraction of the cylinder 26 rod. The frame may also carry a guide 50 for the floating bridge 21, the guide 50 having low friction roller guides 51 acting on an extension of bridge 21 that caries the anvil 16.

The supports for the reference spring 23 are indicated generally at 22' and include blocks 35 slidably carried by the floating bridge 21. The blocks 35 are engaged by a lead screw 36 which may be driven in any desired manner, as by a stepper motor 37, allowing an adjustment of the spacing between the blocks 35. Extending from each of the blocks 35 are a pair of rods 38 (one shown) with the pair of rods associated with each of the blocks 35 carrying a rolling support 39 for the reference spring 23. The rolling supports 39 for the reference spring 23 will be described more fully below with reference to FIGS. 4 and 5. For the purposes of the present discussion, it will be apparent that rotation of the lead screw 36 will allow the spacing between the supports 39 to be adjusted to allow an adjustment in the spring constant of the reference spring 23.

Transducer 19 may be supported by the work table 30 to engage the undersurface of the workpiece 15. Similarly, the transducer 27 may be carried by a block 40 at the end of the rod of cylinder 26, the block 40 also carrying the ram 25. As noted above, with the spring constants of the reference spring 23 and workpiece 15 matched, the floating bridge 21 will move one-half the distance of movement of the ram 25. So as to provide a "zeroed" output of differential transducer 27 on movement of the ram 25 and bridge 21 (indicating a balance in the spring constants of workpiece 15 and spring 23) a summing node 43 is carried by the floating bridge 21 and is connected, as by a tape 44, to the transducer 27 and to a support 45 anchored to the vertical support 31 of the machine frame. If desired, a stepper motor 46 and threaded rod 47 may be provided, with tape 44 being anchored to a sleeve 48 threadedly engaging the rod 47. As will be apparent to those familiar with the art, the stepper motor 46 may be employed to provide an automatic zeroing of the transducer 27. In any event, junction 43 will result in a "doubling" in one input to the transducer 27 in a manner known to the prior art.

The utilization of stepping motors 37 and 46 and the outputs of the transducers 19 and 27 allow an automation of the control 20 such that an operator need only place a workpiece 15 onto the supports 17 and manipulate that workpiece to provide an output from the transducer 19 indicative of the amount of deformation necessary to straighten the workpiece 15. Thereafter, adjustment of the spring constant of the reference spring 23 (via movement of the blocks 35) may be automatically accomplished as may the ultimate determination of the workpiece 15 by deflection to the yield point and subsequent deflection to the desired point of additional deformation, that additional deformation being monitored by the transducer 19. By way of example, and assuming an initial determination by transducer 19 of a variation of the workpiece 15 from "straight" represented by X, the amount of "correction" is found by dividing the quantity X by two. That result is then multiplied by a factor or coefficient dependent upon the plastic deformation characteristics of the material being straightened. Typically, that coefficient will usually be no less than one and will seldom exceed two. It is easily within the ability of one ordinarily skilled in the art to determine this coefficient. Additionally, with ongoing straightening operations of a batch of parts in a given lot, the effectiveness of the straightening operation may be monitored. Dependent upon that effectiveness, the coefficient can be modified and, in any event, either by way of initial coefficient determination or coefficient modification, the desired quantity may be entered into the control 20 to be implemented in any desired manner.

One concern in repetitive straightening operations of multiple parts without change of the reference spring 23 is a hysteresis effect on the reference spring. Interactions between the spring and its supports are also a concern. FIGS. 4 and 5, which are portions of the preferred embodiment illustrated in FIG. 3, illustrate how the present invention addresses these concerns.

FIG. 4 illustrates the interaction of a block 40 with the reference spring 23, with the rod of the cylinder 26 fully extended. The block 40 is provided with a shoulder 50 which engages the reference 23 to lift the spring 23 from the rolling supports 39. This lifting may be effected between each straightening operation to result in a "resetting" of the reference spring 23 on the supports 39 for each straightening operation. Additionally, the members 38 may be provided with sufficient flexibility to "bend" inward (as illustrated in FIG. 5) as the reference spring 23 is deflected to compensate for the foreshortening of the reference spring 23 during its deflection, thereby providing a rolling support on the members 39.

Obviously, many modifications and variations of the present invention are possible in light of the above teachings. For example, automation of the operation of the illustrated embodiment has been discussed and may be implemented to any desired degree. It is therefore to be understood that, within the scope of the appended claims, the invention may be practiced otherwise than is specifically described.

What is claimed is:

1. In a press for straightening and similar operations of the type wherein a workpiece is supported for deflection in a given direction and having anvil means engageable with said workpiece, the improvement which comprises reference spring means, means supporting said reference spring means for deflection thereof in a particular direction, means for imparting a deflecting force to said reference spring means and means serially interconnecting said reference spring supporting means and said anvil means.

2. The press of claim I wherein said serially interconnecting means comprises floating bridge means, said floating bridge means carrying both of said reference spring supporting means and said anvil means.

3. The press of claim 2 wherein said given and particular directions are generally parallel.

4. The press of claim 2 wherein said given and particular directions are generally coincident.

5. A straightening press for a workpiece which comprises:

means for supporting a workpiece while allowing deflection in a given direction;

anvil means engageable with said workpiece for deflection thereof;

reference spring means;

means for supporting said reference spring means while allowing deflection thereof in a particular direction;

floating bridge means carrying said anvil means and said reference spring supporting means;

ram means engageable with said reference spring means and moveable to deflect said reference spring means in said particular direction;

means responsive to the deflection of said workpiece for control of total workpiece deflection; and means responsive to the movement of said ram means and said floating bridge means for detection of plastic yield of said workpiece.

6. The straightening press of claim 5 wherein said given and particular directions are generally parallel.

7. The straightening press of claim 5 wherein said given and particular directions are generally coincident.

8. The straightening press of claim 5 wherein the spring constant of said reference spring means is alterable.

9. The straightening press of claim 5 wherein said reference spring means supporting means is adjustable to alter the spring constant of said reference spring means.

10. A straightening press for a workpiece which comprises:

a stationary work table;

adjustable workpiece supports positioned on said work table, said workpiece supports allowing workpiece deflection toward said work table;

anvil means positioned to engage a workpiece supported by said workpiece supports and moveable to deflect a workpiece toward said work table;

reference spring means;

reference spring means support means;

floating bridge means carrying and moveable with said anvil means and said reference spring means support means;

ram means engageable with said reference spring means and moveable to deflect said reference spring means;

means for detecting the deflection of the workpiece; and means responsive to the relative movement between the ram means and floating bridge means for detecting plastic yield of said workpiece;

wherein workpiece deformation is initially established by said deflection detecting means, said ram means is moved to deflect said reference spring means and said workpiece, via said floating bridge means, until plastic yield of said workpiece is detected and further deflection of said workpiece is monitored via said deflection detecting means.

11. The straightening press of claim 10 wherein said workpiece and said reference spring means are elongated members.

12. The straightening press of claim 11 wherein said reference spring means support means comprises means supporting an adjustable span of said elongated reference spring means.

13. The straightening press of claim 11 wherein said reference spring means support means comprises a pair of spaced blocks carried by said floating bridge means, a pair of rolling support means each associated with a different one of said blocks and underlying said elongated reference means at spaced locations, and rod means extending between each of said blocks and associated rolling support means and further comprising lead screw means engaging said blocks for adjusting the span between said rolling support means.

14. The straightening press of claim 11 wherein said spring means support means comprises a pair of rolling support means underlying said elongated reference means at spaced locations and means extending between said floating bridge means and rolling support means for flexing on foreshortening of said reference spring means during deflection.

15. The straightening press of claim 14 wherein the spaced between said pair of rolling support means is adjustable.

* * * * *

UNITED STATES PATENT AND TRADEMARK OFFICE

CERTIFICATE OF CORRECTION

PATENT NO. : 4,912,957

DATED : April 3, 1990

INVENTOR(S) : Paul S. Petersen et al.

It is certified that error appears in the above-identified patent and that said Letters Patent is hereby corrected as shown below:

Column 6, line 28, delete "claim I" and insert --claim 1--.

Signed and Sealed this

Sixth Day of August, 1991

*Attest:*

HARRY F. MANBECK, JR.

*Attesting Officer*

*Commissioner of Patents and Trademarks*